United States Patent [19]

Moss

[11] 4,074,107

[45] Feb. 14, 1978

[54] COMFORT QUILT

[75] Inventor: Margurita L. Moss, N. Miami Beach, Fla.

[73] Assignee: The Raymond Lee Organization, Inc., New York, N.Y.

[21] Appl. No.: 733,808

[22] Filed: Oct. 19, 1976

[51] Int. Cl.[2] ..... H05B 1/00

[52] U.S. Cl. ..... 219/212; 128/376; 219/529

[58] Field of Search ..... 219/212, 527–529, 219/545, 548, 549; 128/376

[56] References Cited

U.S. PATENT DOCUMENTS

| | | | |
|---|---|---|---|
| 2,850,617 | 9/1958 | Coldren | 219/529 |
| 3,072,776 | 1/1963 | Quenneville | 219/212 |
| 3,443,066 | 5/1969 | Weibel | 219/527 |

*Primary Examiner*—C. L. Albritton
*Attorney, Agent, or Firm*—Howard I. Podell

[57] ABSTRACT

A quilt shaped to fit about the top surface, sides and bottom edges of a mattress. The quilt is formed of insulated cotton material with a continuous electrical heating element embedded in the top sheet which is covered by a waterproof plastic cover sheet bonded to the top sheet. The heating element is externally connected to a control box for regulating the flow of the electricity to the heating element.

1 Claim, 3 Drawing Figures

COMFORT QUILT

SUMMARY OF THE INVENTION

My invention is a quilt shaped to fit about the top surface, sides and bottom edges of a mattress. The quilt is formed of insulated cotton material with a continuous electrical heating element embedded in the top sheet which is covered by a waterproof plastic cover sheet bonded to the top sheet. The heating element is externally connected to a control box for regulating the flow of electricity to the heating element.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
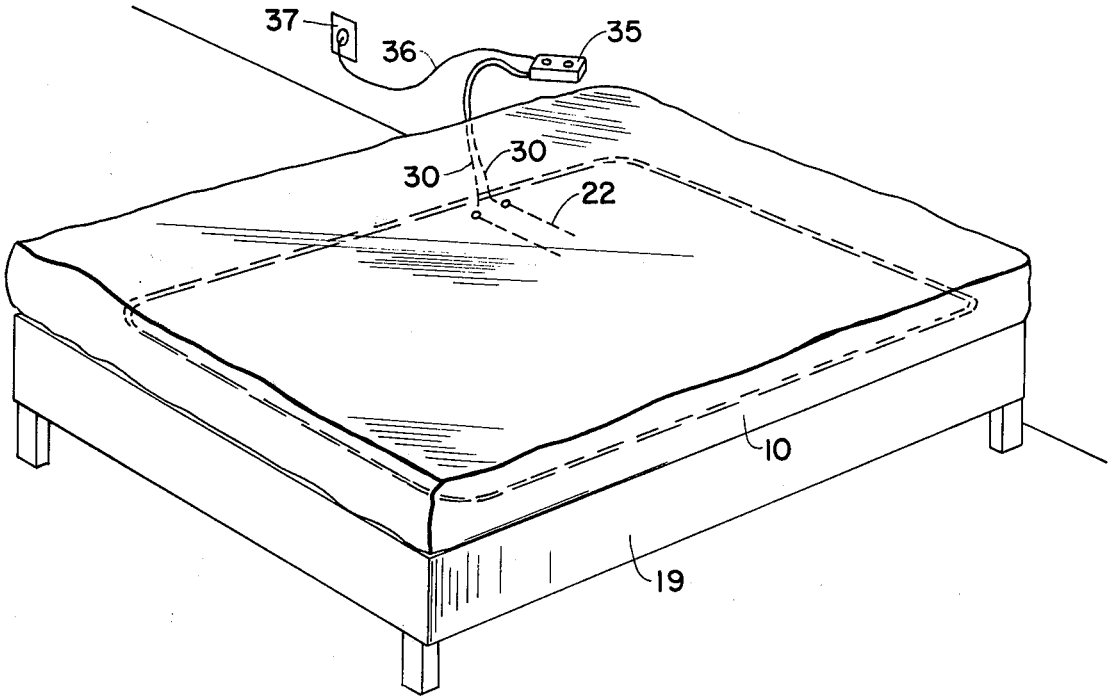
FIG. 1 is a perspective view of the invention in use.
Figure 2:
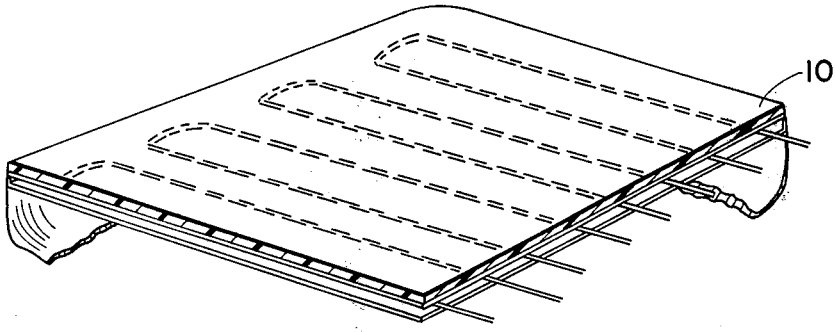
FIG. 2 is a perspective detail view of the invention.
Figure 3:
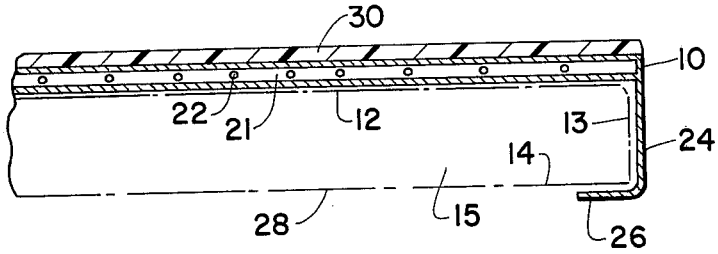
FIG. 3 is a sectional detail view of the invention.

Turning now descriptively to the drawings, in which similar reference characters denote similar elements throughout the several views, FIGS. 1–3 illustrate the quilt 10 which encloses the top surface 12, sides 13 and bottom edge surfaces 14 of a mattress 15 lying on a bed 19.

Quilt 10 is formed of a top sheet 21 in which a continuous electrical resistance heating element 22 is embedded. Top sheet 21 is formed of insulated cotton fabric joined at its edges to a continuous side sheet 24 of cotton fabric that extends about the four sides 13 of an enclosed mattress 15 and is fitted with a continuous flange 26 that extends about the undersurface 28 of the mattress about the bottom edge surfaces 14.

A cover sheet 30 of waterproof plastic material is bonded to the top exterior surface of the top sheet 22.

Electrical element 22 is connected by wires 30 to a control box 35 fitted with means to regulate the flow of electricity to element 22, with control box 35 joined by a flexible power cord 36 to an electrical outlet 37.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A quilt, shaped to fit about the top surface, sides and bottom edges of a mattress to which the quilt may be attached, such that the quilt may be directly attached to a said mattress, so as to serve as an electrically heatably waterproof mattress cover; upon which a user may rest, said quilt formed of a top surface of insulated fabric in which an electrical heating element is embedded, together with a cover of waterproof plastic sheeting bonded to the exterior surface of said fabric.

* * * * *